US005515701A

United States Patent [19]

Schubert

[11] Patent Number: 5,515,701

[45] Date of Patent: May 14, 1996

[54] METHOD AND APPARATUS FOR PRODUCING MULTICOLORED JACQUARD-PATTERNED, KNITTED PILE FABRICS

[75] Inventor: Frank Schubert, Chemnitz, Germany

[73] Assignee: Kaendler Maschinenbau GmbH, Kaendler, Germany

[21] Appl. No.: 303,964

[22] Filed: Sep. 9, 1994

[30] Foreign Application Priority Data

Oct. 14, 1993 [DE] Germany ..... 43 35 109.3

[51] Int. Cl.[6] ..... D04B 21/02; D04B 23/08; D04B 25/08

[52] U.S. Cl. ..... 66/204; 66/84 R

[58] Field of Search ..... 66/84 R, 204, 66/207, 203, 214

[56] References Cited

U.S. PATENT DOCUMENTS

| | | | |
|---|---|---|---|
| 3,141,315 | 7/1964 | Smith | 66/204 |
| 4,266,411 | 5/1981 | Lindner et al. . | |
| 4,389,860 | 6/1983 | Schneider . | |

FOREIGN PATENT DOCUMENTS

| | | | |
|---|---|---|---|
| 139608 | 10/1978 | German Dem. Rep. | 66/84 R |
| 136986 | 8/1979 | German Dem. Rep. . | |
| 156330 | 8/1982 | German Dem. Rep. . | |
| 207634 | 3/1984 | German Dem. Rep. . | |
| 207941 | 3/1984 | German Dem. Rep. . | |
| 242245 | 1/1987 | German Dem. Rep. | 66/84 R |
| 140767 | 3/1980 | Germany . | |
| 141687 | 5/1980 | Germany . | |
| 0153399 | 1/1982 | Germany . | |
| 0153400 | 1/1982 | Germany . | |
| 130604 | 12/1959 | U.S.S.R. | 66/84 |

*Primary Examiner*—John J. Calvert
*Attorney, Agent, or Firm*—Jordan and Hamburg

[57] ABSTRACT

The invention relates to a method and to an apparatus for the production of multi-colored, Jacquard-patterned knitted pile fabrics, the patterning pile yarns being attached to the foundation texture preferably in filling construction and the non-patterning pile-yarns being held predominantly stretched at the foundation texture and, during the knitting process, the group of pile yarns being moveable in closed channels of a guide comb in the traverse and racking direction and the selected patterning pile yarns, guided by means of a pile yarn guide, forming a shed with the non-patterning pile yarns and being supplied by the guide comb in a first course to the reacher-in for accurate racking for the underlapping, the patterning pile yarn, in the second or return course after renewed racking, also being underlapped, tied in and returned in the channel of the guide comb to the dead pile strand and, after the selection of a new patterning pile yarn, the process with the shed formation by the new patterning pile yarn commencing once again. With the objective of increasing the operating speed of the machine, the selected patterning pile yarn, immediately after being taken hold of by the needle, is returned during the first course, the selected patterning pile yarn is also underlapped in the second course by lowering the guide comb and the new patterning pile yarn selected for the subsequent cycle is selected approximately between the casting off of the stitch in the first course and the start of the underlapping in the second course and brought into the shed plane of the patterning pile yarns approximately from the commencement of the underlapping of the second course.

16 Claims, 4 Drawing Sheets

METHOD AND APPARATUS FOR PRODUCING MULTICOLORED JACQUARD-PATTERNED, KNITTED PILE FABRICS

BACKGROUND OF THE INVENTION

The invention relates to a method for producing multicolored, Jacquard-patterned knitted pile fabrics, comprising a ground fabric or warp and a pattern-forming system of pile yarns. For this method, the pattern-forming pile yarns in a knitted pile fabric are attached to the ground fabric preferably in filling pile construction and the non-patterning pile yarns, are held at the ground fabric, the pile yarns are assigned group-wise to each needle wale and, during the knitting process, the pile yarn group can be moved in closed channels of a guide comb in the traverse and racking directions. The selected patterning pile yarns, controlled by means of a non-patterning pile yarn guide, form a shed with the non-patterning pile yarns and are fed by the guide comb in a first course to a pile yarn inlayer for the precise racking for the underlapping. The pile yarn inlayer presses off the underlapped patterning pile yarn during the tying. In the second or returning course, after renewed racking, the patterning pile yarn is also underlapped, tied in, guided back in the channel of the guide comb to the non-patterning pile strand and, after a new patterning pile yarn has been selected, the process of forming the shed is commenced again by the new patterning pile yarn.

The German Democratic Republic patent 242 245 discloses a knitting machine for knitted pile fabrics, which has with a horizontally disposed row of slide needles, with pile sinkers with a filling rigger behind the pile sinkers, and a knitting yarn guide swivelling before the needle head.

The assemblage of pile yarns is arranged in groups and passed through a guide comb in channels. At the same time, the non pile yarns, which are also referred to as non-patterning pile yarns, are guided into a shed plane near the pile sinkers and the patterning pile yarns, at a distance from the pile sinkers, are guided into a second shed plane.

Individually movable non-patterning pile yarn guides, which are known as such and controlled by a Jacquard machine to form a shed, make the shed ready for the independent control of patterning pile and non-patterning pile.

A pile yarn inlayer, which is movable below the sinkers of the guide comb and above the plane of the needles vertically, in the racking direction and also in the longitudinal direction of the needles, has a hook, which is open towards the top and the rear. With that, the pile yarn inlayer takes hold of the patterning pile yarn by means of an appropriate motion and laps the patterning pile yarn under an adjacent needle or over the hook in the first course.

While stitches are being cast off in the first course, the pile yarn inlayer holds the patterning pile yarn and thus also underlaps or overlaps in the second or returning course. When this process is concluded, this pile yarn inlayer releases the patterning pile yarn through an appropriate motion. This patterning pile yarn can now be taken back to the assemblage of the non-patterning piles. A new, patterning pile yarn is selected and brought into the front shed plane to form a shed.

This procedure is very disadvantageous with respect to the performance parameters of the machine.

After the patterning pile yarn is taken hold of by the needle in the second course, the pile yarn inlayer must be aligned initially very precisely in a particular position to the sinkers of the guide comb for returning the patterning pile yarns. This requires much time and entails many uncertainties, because, due to the casting off motion of the needle and the formation of pile loops, significant lateral stress is placed on the patterning pile yarns, particularly in this phase. The pile yarn inlayers and the sinkers of the guide comb are therefore deflected laterally.

The angle of rotation, subsequently available for returning the patterning pile yarn, for the new selection by the Jacquard machine, for the formation of a new shed and for the renewed taking hold of the patterning pile yarn by the pile yarn inlayer up to the racking and underlapping of the patterning pile yarn, is so tightly dimensioned, that an appropriate working speed and, with that, an appropriate productivity of the machine cannot be assured under industrial conditions.

Aside from the patent mentioned, other patents describe a large number of very similar variations of the method for selecting and tying in patterning piles and non-patterning piles during the production of Jacquard-patterned, knitted pile fabrics. By way of example, reference is made here to the German Democratic Republic patents (DD) 140 767, 153 399, 207 941 and 136 986.

For all the methods presented in the prior art, the same negative phenomena with respect to the concentration of functionally important movements of the stitch-forming elements in a narrowly limited angular region occur.

To improve the combined action between the sinkers of the guide comb and the pile yarn inlayer, the latter was provided with an upwardly directed projection, which remained constantly in engagement with the second channel of the guide comb (DD patent 156 330). With that, a frequently desired, mutually independent racking of guide comb and pile yarn inlayer is sacrificed for functional reasons.

The production of a knitted pile fabric, for example, by the method of the patent 207 941, admittedly was possible in principle with a method thus limited and with such an apparatus. However, the productivity of the pile knitting machine remained greatly limited. Especially with larger working widths of up to 4 meters, neither the method nor the apparatus is usable.

There are special problems with the known methods especially when the patterning pile yarns are attached to the foundation fabrics in the pile material-saving filling construction. The reason for this lies therein that, in the case of the above method, the newly selected pile yarn is racked at a very early point in time in the first course following the selection process and must be brought into the underlapping position.

SUMMARY OF THE INVENTION

It is an object of the invention to increase the operating speed of the pile knitting machine with a high degree of reliability in the realization of multi-colored filling constructions.

The objective of the invention consists of finding a method which, as a function of a continuously oscillating needle motion, has sufficient time available for returning the patterning pile, for forming the new shed in accordance with the pattern and for taking hold of, racking and underlapping the new patterning pile yarn.

The apparatus for carrying out the method shall ensure a reliable interaction of guide comb and pile yarn inlayer and, at high frequency of stitch formation, also make possible the underlapping of the patterning pile and the counternotation tying in of patterning pile and non-patterning pile—related to the reference needle.

Pursuant to the invention, this objective is accomplished by the method steps wherein a patterning pile yarn selected immediately after being taken hold of by the needle and within the first course commences with the return motion to selected position, a patterning pile yarn selected in the second course is underlapped by lowering the guide comb, and a new patterning pile yarn selected for the following cycle approximately between casting off the stitch in the first course and start of second course underlapping is selected by the Jacquard machine and approximately with the commencement of the underlapping of the second course is brought by its pile yard guide into the shed plane of the patterning pile yarns.

The transfer of the function of the underlapping of the patterning pile yarn under the needles in the second course, from the pile yarn inlayer to the guide comb, makes it possible to guide the selected patterning pile yarn into the assemblage of non-patterning piles and to initiate a new selection and shed formation at the start of the tying process in the first course. By means of this measure, it is possible to fix the operating speed of the machine almost independently of the pattern selected. The movements by means of which the pile yarn inlayer takes hold of the patterning pile yarn in the first course and the racking and underlapping motions of the pile yarn inlayer are arranged according to optimum laws of motion.

The method ensures reliable racking of the patterning pile yarn in the movement region of the pile yarn inlayer without any adverse effect on the different tying in of the patterning pile and the non-patterning pile.

The apparatus provided by the invention ensures the undisturbed interaction of the guide comb and the pile yarn inlayer, particularly during the restoration of the initial position for racking and taking hold of the new patterning pile yarn. Deflections of the sinkers of the guide comb and uncontrollable oscillations are avoided by this arrangement. Special assurances for the introduction of the pile yarn inlayer into the second channel of the guide comb are provided by the second channel being wider in the region of motion of the pile yarn inlayer than in the region of the motion of the needle.

The insertion of the connecting pieces in a guide comb of very small mass and with little expenditure of effort for the production is effected by connection pieces at the sinkers made of plastic and being gated. An appropriate arrangement of the guide comb has individual mountings as bearings for the sinkers and the connecting pieces are flatter at edge sides than connecting pieces gated at either side.

The method described and the apparatus made available for the method for the first time make it possible, under large-scale industrial conditions, to produce a knitted pile fabric in the width adapted to the requirements, for which the patterning piles are lapped in alternating directions over pile sinkers under two needles and the non-patterning piles are stretched in a channel adjoining this pair of needles and piled loosely under the pile loops.

The apparatus also permits knitted pile fabrics to be produced, for which the non-patterning pile is tied in as a so-called stationary filling into a needle wale participating in the pile formation.

With appropriate arrangement of the driving elements, the apparatus can be used for practically any mode of operation. A plurality of filling pile constructions and tying of stitches of the patterning pile is realizable.

Pile formation in each second row, as disclosed in the DD 141 687, where stitch of the patterning pile yarn does not have to be pulled over the filling of backing, can also be realized with this apparatus.

BRIEF DESCRIPTION OF THE DRAWINGS

The invention is explained in greater detail in the following description with reference to the figures wherein.

DETAILED DESCRIPTION OF THE INVENTION

Figure 1:
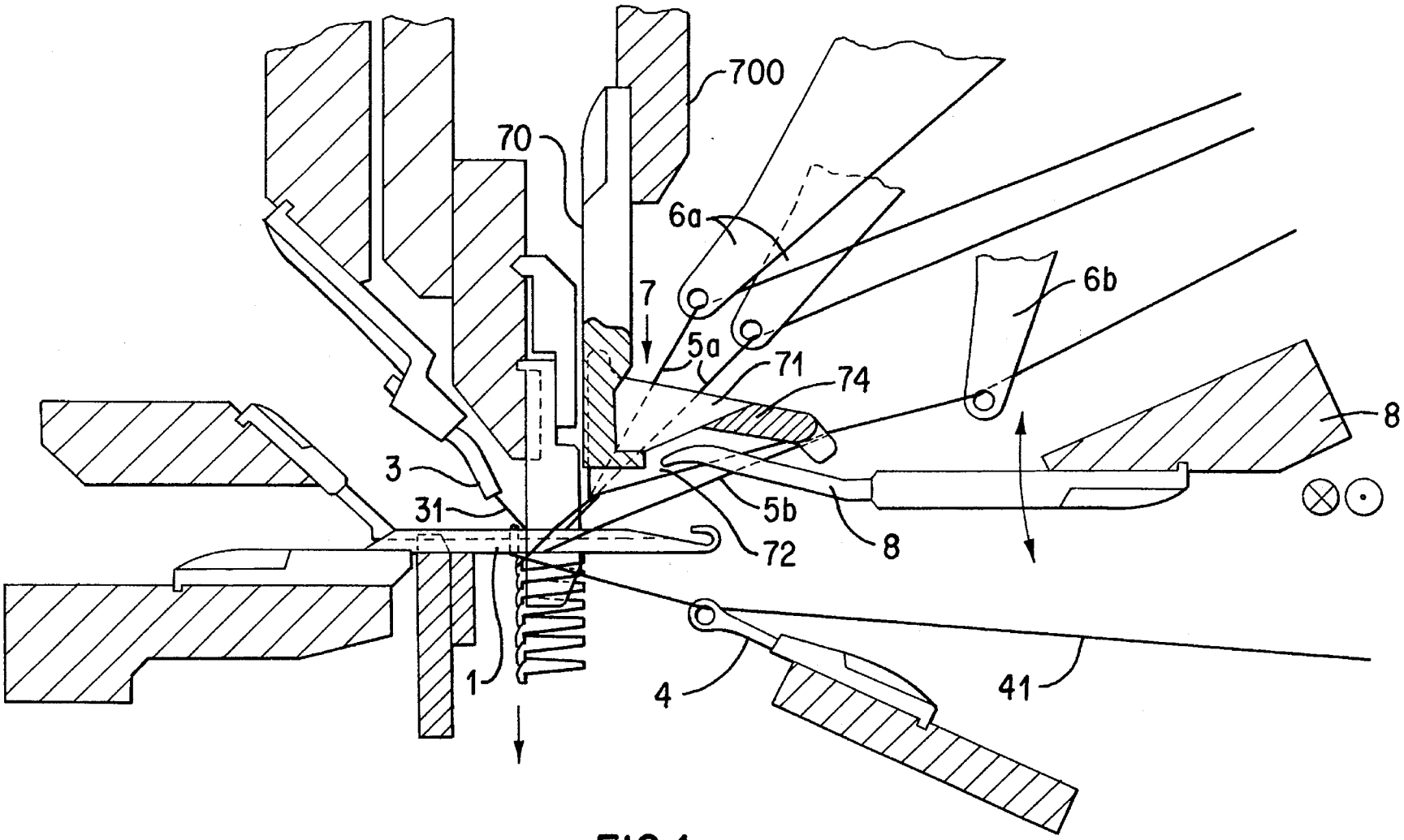
FIG. 1 shows a cross section through the stitch-forming zone of a pile knitting machine.

Referring to FIGS. 1–4, pile knitting machine is equipped with a horizontally disposed needle bar. It has needles 1, which preferably are constructed as slide needles. The slides of the needles 1 are mounted in a separate bar and can be driven.

Above a casting-off plane, a weft yarn guide 3 is positioned, which is raised and lowered vertically and is racked in alternating directions over several needle spacings.

In front of the casting-off plane, stationary pile sinkers 2 reach through the needle channels from above. A known knitting yarn guide 4 oscillates rhythmically in front of the needle plane and is in a position to place its knitting yarn 41 in a cycle of the stitch formation into the needle hook. The elements for supplying and laying the pile yarn are disposed between this knitting yarn guide 4 and the bar of the pile sinkers 2.

All the pile yarns 5*a* and 5*b* are supplied from above the needle plane. The pile yarns 5*a* and 5*b* of a group, which are assigned either to needle spacing or a reference needle 10, are supplied by pile yarn guides 6*a*, 6*b*. The pile yarn guides 6*a*, 6*b* are individually movable approximately in the dividing plane of the needles 1. The starting and selection position of the pile yarn guides 6*a*, 6*b* is near a sinker mount 70 of the sinkers 71, 72 of a guide comb 7. The pile yarns 5*a*, guided there by the non-patterning pile yarn guides 6*a*, are tied in as non-patterning pile yarns 5*a* (dead piles). The pile yarn guide 6*b*, with its patterning pile yarn 5*b* selected according to a pattern by a Jacquard machine, which is not shown, is swung out towards an operator side of the machine forming a shed. At the time at which the patterning pile yarn 5*b* is taken hold of by a pile yarn inlayer 8, the patterning pile yarn 5*b* lies in a channel 75 proximate a spacer 73.

All pile yarns 5*a*, 5*b* of a group are conducted in the first channel 75 of the guide comb 7 in the region of the opened shed (5*a*, 5*b*). The first channel 75, which is bounded by the sinkers 71, 72, shields the pile yarns 5*a*, 5*b* with respect to the needle point 1 and with respect to the tip of the pile yarn inlayer 8 intermittently dipping in.

A tip of the pile yarn inlayer 8 extends into a space between a plane of the non-patterning pile yarns 5*a* and the plane of the patterning pile yarns 5*b*. By racking the guide comb 7 above the needle plane (1), the respectively selected patterning pile yarn 5*b* reaches obliquely underneath the throat of the pile yarn inlayer 8 and, independently of the racking motion of the guide comb 7, the patterning pile yarn 5*b* is lapped under a needle 1 or introduced into its hook.

Figure 2:
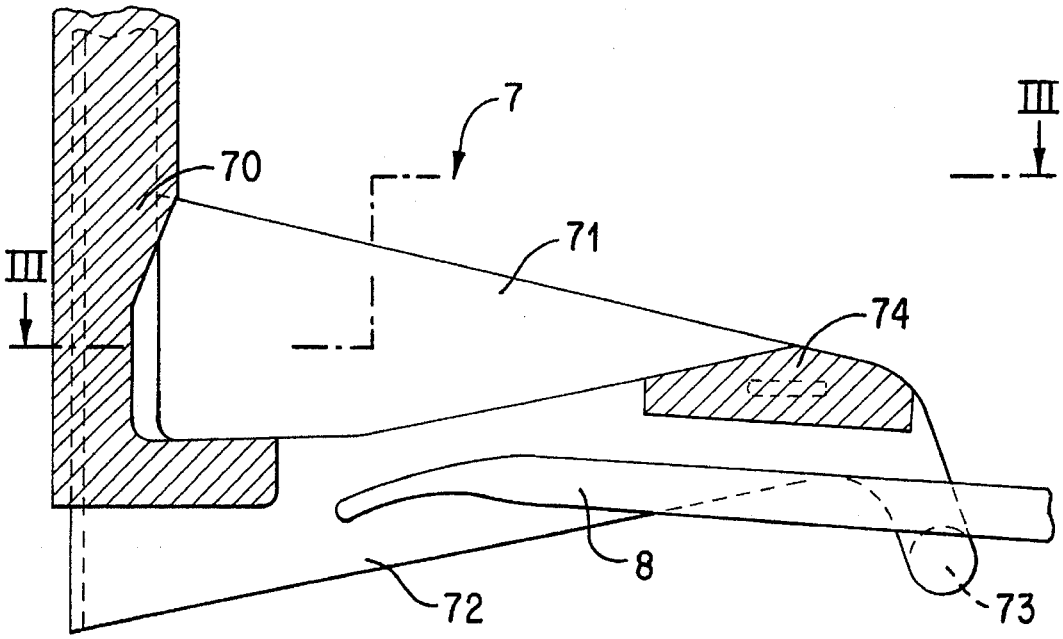
FIG. 2 shows a cross section through the guide comb along the line II—II of FIG. 3.
Figure 3:
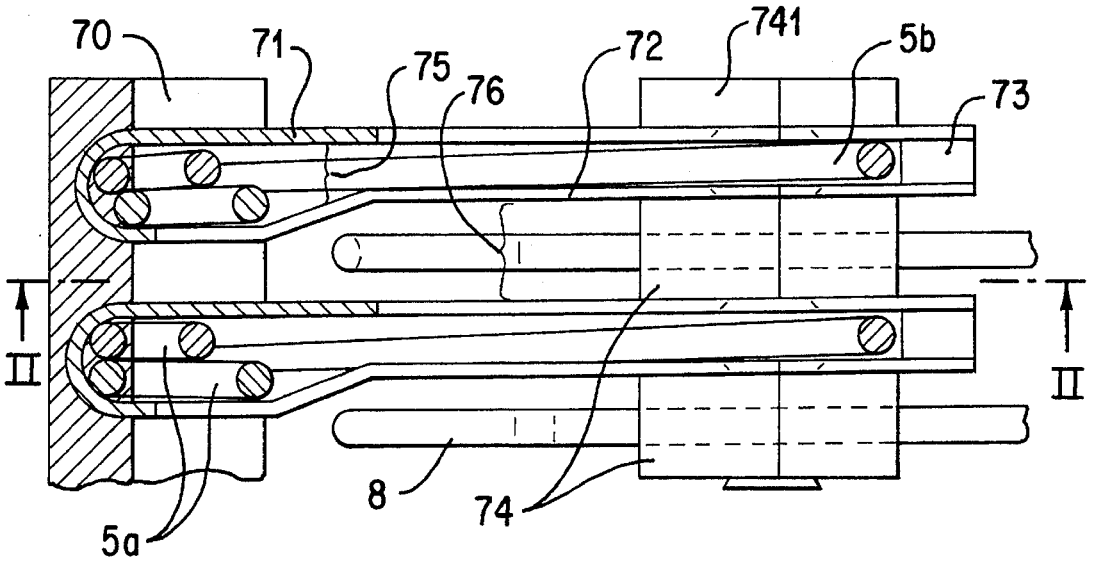
FIG. 3 shows a section through the guide comb along the line III—III of FIG. 2.

The embodiment of the guide comb 7, which is shown on an enlarged scale in FIGS. 2 and 3, has a relatively large space shielded securely from the region of motion of the needle tip (1) is required for guiding the non-patterning pile yarn assemblage 5*a* of a group in the first channel 75. The step-wise configuration of the channels 75, 76 provides for fulfilling this requirement.

For each new selection of the patterning pile yarn 5*b*, the latter must be pulled out of the strand of the non-patterning pile yarns 5*a* for the purpose of forming the shed.

The widened space in the first channel 75 of the guide comb 7 is sufficient for forming the shed. In the opposite region of the first channel 75, a lesser width of the channel 75 is adequate. It need only be wide enough to afford passage to a single yarn, optionally with knots. The space gained in front region is made available to the pile yarn inlayer 8, which intermittently dips into a second channel 76.

To avoid oscillations of the sinker 71, 72 of the guide comb 7, connecting pieces 74 bridging the second channel 76 are provided in addition to the spacers 73 that close the first channel 75 at the front. The connecting pieces 74 are disposed where neither needle 1 nor pile yarn inlayer 8 have to be moved.

The guide comb 7 has a plurality of sinker mounts 70 into each of which a number of the sinkers (71, 72) are fixed. The sinker mounts 70 are in turn detachably fastened to a comb bar 700 adjacent one another. The connecting pieces 74 are disposed between each of the comb guides sinkers 71, 72 defining the second channels while end spacers 741 are disposed on sides of guide sinkers 71 and 72 at each end of the sinker mounts 70. The end spacers 741 are thinner than the connecting pieces 74 so that a spacing defined by two of the end spacers 741 abutting one another is equivalent to that of the connecting pieces 74.

Through this arrangement of the free ends of the sinkers 71, 72 of the guide comb 7, these free ends, in interaction with the sinker mounts 70 of the sinkers 71, 72, are stabilized in such a manner that they can reliably withstand even large lateral tensile forces of the yarns, which can arise during the formation of pile loops.

Referring to FIGS. 8*a*–8*f*, the individual steps of the method for the selection and threading of a group of pile yarns, which are assigned to a reference needle 10, a reference pile sinker 20 and a reference channel 750 in the guide comb 7, are detailed as follows.

Figure 8A:
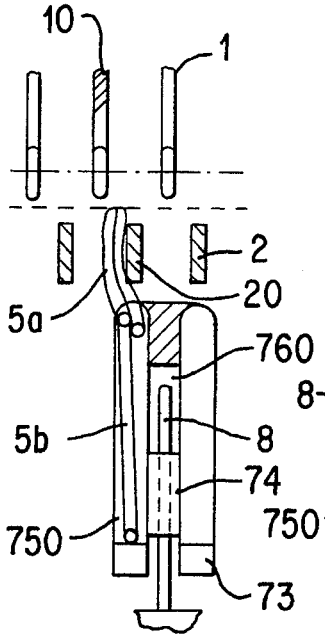
FIG. 8*a* shows a plan view diagram of the embodiment of Fig. the present invention in a state of operation during a first course mutually interacting working elements for guiding and processing a group of pile yarns in six consecutive positions in a 2-course mode of working.

All the needles 1 are initially in the casting-off position in FIG. 8*a* (shown by the line of dots and dashes). The guide comb 7 is represented by a section of two sinker pairs 71, 72, a first reference channel being labeled 750 and a second reference channel 760. The remaining, adjacent elements have been omitted for better clarity. The first reference channel 750 is in the plane of the pile sinker 2, which is adjacent to and to the left of the reference pile sinker 20 and also to the right of the reference needle 10. The pile yarns 5*a* and 5*b* extend from the reference channel 750 around the pile sinker 2 and into the region of the finished, knitted pile fabric (broken line).

Within the channel 750, the patterning pile yarn 5*b* is swung out towards the front. Together with the non-patterning pile yarns 5*a*, it forms a shed within the reference channel 750, as can be seen in FIG. 1.

Figure 8B:
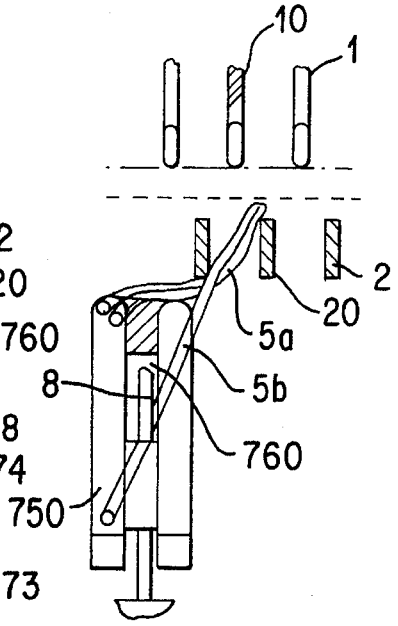
Figure 8C:
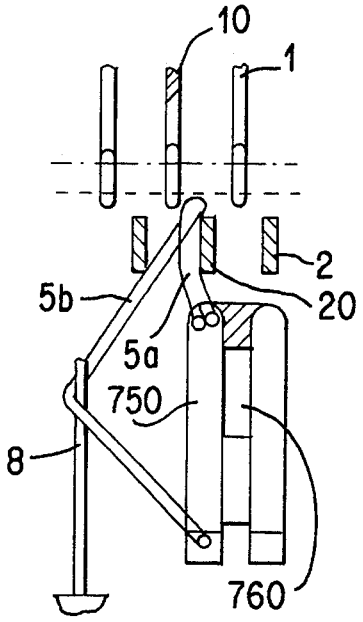

For the purpose of handing over the patterning pile yarn 5*b*, which has been selected for the patterning, to the pile yarn inlayer 8, the guide comb 7 is offset to the left by about three to four needle spacings (FIG. 8*b*). The pile yarn inlayer 8 follows this movement and swivels downwards at an end of the traverse. In this way, the pile yarn inlayer 8 moves over the patterning pile yarn 5*b*. The guide comb 7 moves back over the pile yarn inlayer 8 back into its starting position (FIG. 8*c*).

The guide comb 7 and the pile yarn inlayer 8 are now lowered. At the same time, the guide comb 7, with its edge facing the pile sinkers 2, presses the non-patterning pile yarns 5*a* below the needle plane, to allow the needles 10, 1 to be moved over the non-patterning pile yarn strand 5*a* through the channel between the pile sinkers 20, 2.

The pile yarn inlayer 8 has meanwhile also reached its lowest position. The reference needle 10 crosses over the patterning pile yarn 5*b* first, followed by the immediately adjacent needle 1.

Figure 8D:
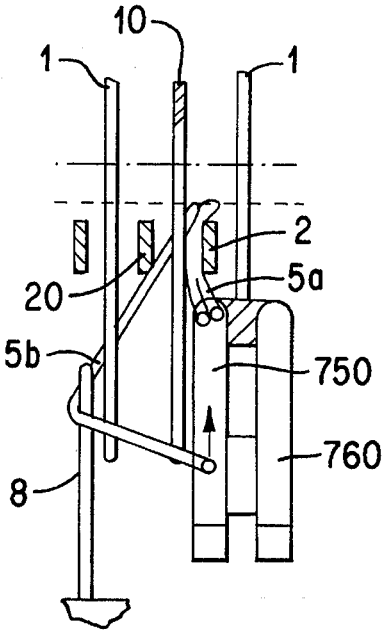

As soon as the second needle 1 can guide the patterning pile yarn 5*b* with its back, the pile yarn inlayer 8 rises over the needle plane and commences the motion toward its reference channel 760 in the guide comb 7 (FIG. 8*d*).

At this time, the selected, patterning pile yarn 5*b* and, with that, its patterning pile yarn guide 6*b* commence return motion to the selection position.

Figure 8E:
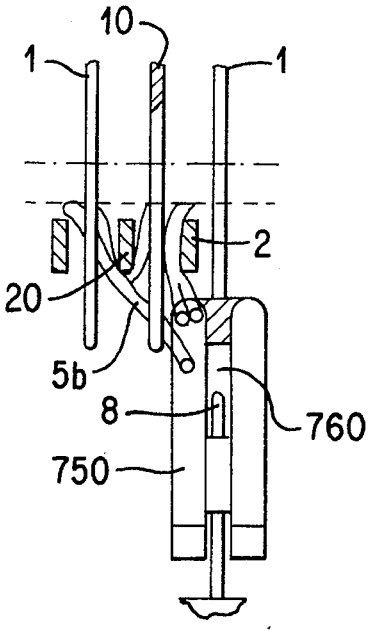
Figure 8F:
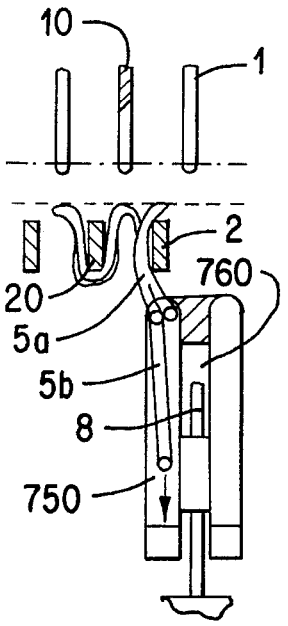

The knitting yarn guide 4 (shown in FIG. 1) now places its knitting yarn 41 into the hook of the needle. Advantageously, this is done in the form of a closed pillar stitch formation. The casting-off motion of the needle 1 in the first course can commence with the hook of the needle closed. At the end of the casting-off motion, the reference channel 750 of the guide comb 7 is again in the starting position in front of the pile sinkers 2 that have been described. The guide comb 7 is lowered, so that all the pile yarns 5*a*, 5*b*, guided by it, are in the underlapping position (FIG. 8*e*).

In the meantime, the patterning pile yarn 5*b*, guided by the patterning pile yarn guider 6*b*, has reached the selection position.

The Jacquard machine, which is not shown, selects a new patterning pile yarn guide 6*b*. The opening of the shed with the newly selected patterning pile yarn 5*b* can, if necessary, commence in the position shown in FIG. 8*e*.

After the knitting yarn 41 (shown in FIG. 1) has been placed once more in the hook of the needle 1, the needle 1 meanwhile is almost at the casting-off plane in the second course once again, presses off the stitch formed from the knitting yarn 41 in the first course and thus completely encloses the patterning pile yarn 5*b*—forming a loop disposed over the pile sinker 20—between the needle stitch and the sinker stitch on the backing. The method described can commence once again at this point.

Figure 4:
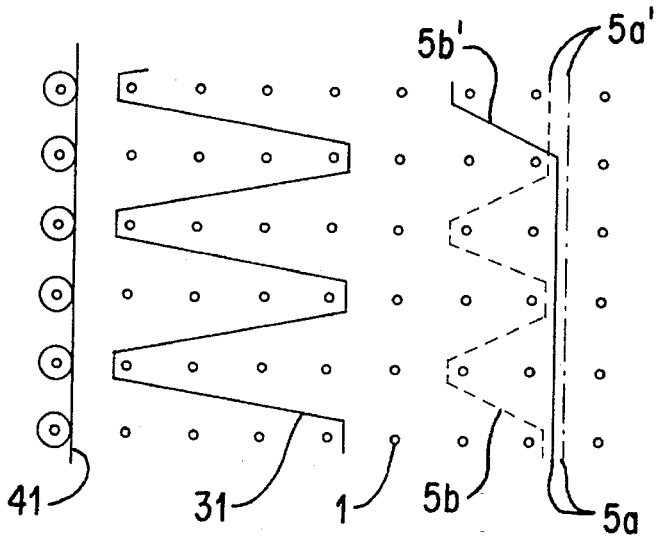
FIG. 4 shows a pattern picture of a first knitted pile fabric, which can be produced by the method described.
Figure 5:
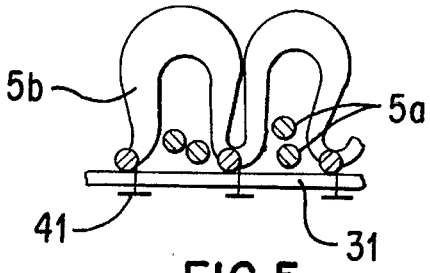
FIG. 5 shows a detailed view of the knitted pile fabric of FIG. 4, cut in the filling direction.
Figure 7:
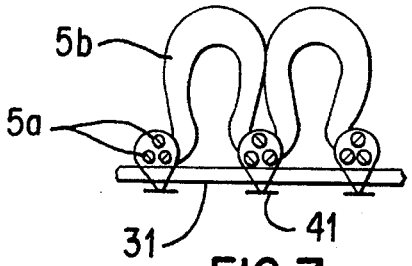
FIG. 7 shows a detailed view of the knitted fabric of FIG. 6 in a sectional representation parallel to the filling direction.

FIGS. 4 to 7 show two examples of a knitted pile fabric with their pattern pictures and a detailed view, into which the knitted pile fabric was cut over three needle wales in the filling direction (FIGS. 5 and 7).

The pattern picture of FIG. 4 is characterized in that the non-patterning pile yarns 5*a* always remain in a channel, which is adjacent to and immediately on the outside of the needles 1 participating in the pattern formation of the pile yarns 5*a*, 5*b*. These non-patterning pile yarns 5*a* lie essentially loosely and stretched under the pile loops formed in this channel.

This manner of tying in the non-patterning pile yarns 5*a* has the advantage that these non-patterning pile yarns 5*a* do not impede the tying of the patterning pile yarn 5*b* and that channels are not formed in the warp direction between the rows of piles. In the region of the right edge of the carpet, the non-patterning pile yarns 5*a* can be covered by the patterning pile yarn 5*b*, always patterning in the same color.

Figure 6:
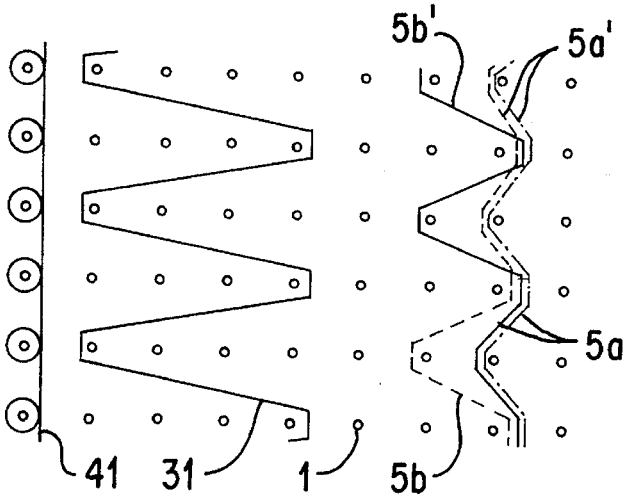
FIG. 6 shows a pattern picture of a second variant of the knitted pile fabric, which can be produced by the method.

If, for certain reasons, it is necessary to pattern up to the edge, the threading should be carried as shown in FIG. 6. An additional pile yarn inlayer, which is not shown and is controlled differently, can rack the non-patterning pile yarns 5*a* there to the left under a needle in each second course. The advantage of this inventive mode of working is that the guide comb 7 with its sinkers 71, 72, between which all pile yarns 5*a* and 5*b* are constantly guided, can also underlap the patterning pile yarn 5*b* in the second course. Within limitations, it is immaterial in which position, relative to the shed, the patterning pile yarn 5*b* is within the channel 75. It does, however, matter that the guide comb 7 is lowered and that also the patterning pile yarn 5*b*, on passage through the needles 1, 10, is so positioned by the pile sinker channel below the plane of the needles, that the second needle 1, as well as the reference needle 10, can reach the clearing position over this patterning pile yarn 5*b*.

Almost a complete revolution of the main shaft of the pile knitting machine is available for the process of selecting a patterning pile yarn 5*b*, including the return of the previously selected patterning pile yarn 5*b*. A further, approximately half course can then be assigned to the taking hold of the selected patterning pile yarn 5*b* by the pile yarn inlayer 8 and to the accurate positioning of the guide comb 7 and the pile yarn inlayer 8 in the specified needle channel and to the underlapping. With that, the motions necessary for the operating elements can be arranged so that the highest working speeds can be reached.

Compared to the initially described method for offering the selective patterning pile yarn 5*b* to the pile yarn inlayer 8 with horizontal racking of the guide comb 7, it is also possible to raise the guide comb 7 by such an amount, that the pile yarn inlayer 8, which descends slightly and moves relative to the guide comb 7 in the racking direction, laterally takes hold of the patterning pile yarn 5*b*, deflects it laterally and laps it under the specified needles 1.

With respect to the forms of motion of the pile yarn inlayer 8 and the guide comb 7, this method is simpler. However, due to the repeated deflection of the patterning pile yarn 5*b*, the method places more stress on the guide comb 7 and on the pile yarn inlayer 8 than in the described case. In practice, an optimum is achievable by a combination of the two possibilities.

The apparatus described is also applicable to tying the pile yarn in the stitch form in a backing. In this case, however, it must be accepted that the return of the patterning pile yarn 5*b* or of its pile yarn guide into the selection position can commence only after the patterning pile yarn is inserted into the hook of the needle during the second course. The later commencement of the pattern selection is acceptable because the insertion of the patterning pile 5*b* into the hook of the needle 1 during the subsequent first course is carried out at a significantly later time. In this case also, acceptable operating speeds are attainable.

I claim:

1. A method for the production of multi-colored Jacquard-patterned knitted pile fabrics with a ground fabric having piles yarns, including patterning and non-patterning pile yarns, in a weft pile construction, the method using an apparatus for pile knitting including:

a row of hooked knitting needles defining a needle plane and means for reciprocatively axially displacing said knitting needles in said needle plane a cycle during a course of knitting;

knitting means for cooperating with said knitting needles and feeding knitting thread onto said knitting needles for forming interlaced adjacent wales of said ground fabric;

a row of stationary pile sinkers perpendicular to said needle plane and defining channels, each of said channels having an associated one of said knitting needles reciprocating therethrough from a cast-off position behind a plane of said stationary pile sinkers to an extended position passing through said plane of said stationary pile sinkers;

a guide comb, adjacent said stationary pile sinkers, having comb sinker plates defining alternating first and second channels therebetween wherein each of said first channels guides a group of said pile yarns at a first end thereof nearest said stationary pile sinkers, each of said second channels accepts an associated one of said knitting needles, and said comb sinker plates have lower inclined edges inclined away from said needle plane;

means for raising and lowering said guide comb to move a lower edge of said guide comb to positions above and below said needle plane, respectively, and means for racking said guide comb parallel to said row of knitting needles;

selecting means for selecting a patterning pile yarn in each of said first channels from said pile yarns by displacement of said patterning pile yarn to a second end of each of said first channels; and a pile yarn inlayer associated with each of said second channels of said guide comb, means for racking said pile yarn inlayers, and means for raising and lowering said pile yarn inlayers, the method comprising:

selecting and displacing a patterning pile yarn from said group of pile yarns at said first end of each of said first channels to said second end of said first channels leaving non-patterning pile yarns at said first end and forming a shed therebetween:

racking said guide comb and pile yarn inlayers from an initial position to a racked position while said knitting needles are positioned behind a plane of said stationary pile sinkers during a first course;

engaging and underlapping said patterning pile yarns with said pile yarn inlayers under said knitting needles;

tying in said patterning pile yarns with knitting yarn placed in the needle hooks when the knitting needles are in extended positions and retracting said knitting needles to said cast-off position to form piles with said patterning pile yarns to tie down said piles and to complete said first course while said pile yarn inlayers disengage from said patterning pile yarns;

returning said patterning pile yarns to said first ends of said first channels substantially immediately subsequent to enclosure by said knitting yarn during said tying and prior to a completion of said first course;

underlapping said patterning pile yarns during a second course by lowering said lower edge of said guide comb below said needle plane at a beginning of said second course and tying down said pile yarns with said knitting yarn; and selecting new patterning pile yarns during said beginning of said second course and displacing said patterning pile yarns to second ends of said first channels of said guide comb during said underlapping and said tying down said patterning yarns with the knitting yarns in said second course.

2. The method of claim 1 wherein:

said engaging of said patterning pile yarns by said pile yarn inlayers includes positioning said patterning pile yarns to a racked position by said racking of said guide comb and disposing said patterning pile yarns at said second ends of said first channels to form an oblique angle crossing said pile yarn inlayers; and said engagement and underlapping of said patterning pile yarns includes moving said pile yarn inlayers independent of said guiding comb.

3. The method of claim 1 wherein said engaging and underlapping of said patterning pile yarns by said pile yarn inlayers includes shifting the guiding comb upwards relative to said pile yarn inlayers and racking and lowering said pile yarn inlayers to hold and underlap the patterning pile yarns.

4. The method of claim 1 wherein said engaging and underlapping during said first course includes:

lowering said pile yarn inlayers from racked positions in said second channels of said guide comb at said racked position to lowered racked positions engaging and underlapping a portion of said patterning pile yarns from a last tying position to said pile yarn inlayers and disposing a remainder of said patterning pile yarns in a path of said knitting needles for engagement effecting holding of the patterning pile yarns by said knitting yarn;

racking said guide comb back to said initial position after said pile yarn inlayers are lowered clear of said guide comb and while said knitting needles remain reciprocated behind said plane of said stationary pile sinkers;

maintaining said pile yarn inlayers in said lowered racked position and moving forward said knitting needles through said plane of said stationary pile sinkers to hold said patterning pile yarns;

racking said pile yarn inlayers back to said initial position after said holding of said patterning pile yarns by said knitting yarn and before completion of said first course; and returning said selected and displaced patterning pile yarns, in each of said first channels, to said first ends of said first channels after said holding of said patterning pile yarns by said knitting yarns and before completion of said first course.

5. An apparatus for the production of multi-colored Jacquard-patterned knitted pile fabrics with a ground fabric having piles yarns, including patterning and non-patterning pile yarns, in a filling pile construction, the apparatus comprising:

a row of hooked knitting needles defining a needle plane and means for a cycle reciprocatively axially displacing said knitting needles in said needle plane during a course of knitting;

knitting means for cooperating with said knitting needles and feeding knitting yarn onto said knitting needles for forming interlaced adjacent wales of a ground fabric;

a row of stationary pile sinkers perpendicular to said needle plane and defining channels, each of said channels having an associated one of said knitting needles reciprocating therethrough from a cast-off position behind a plane of said stationary pile sinkers to an extended position passing through said plane of said stationary pile sinkers;

a guide comb, adjacent said pile sinkers, having comb sinker plates defining alternating first and second channels therebetween wherein each of said first channels guides a group of said pile yarns at a first end thereof nearest said stationary pile sinkers, each of said second channels accepts an associated one of said knitting needles, and said comb sinker plates have lower edges inclined away from said needle plane;

said guide comb having a lower edge parallel to said needle plane;

means for raising and lowering said guide comb to move said lower edge of said guide comb to above and below said needle plane, respectively;

selecting means for selecting a patterning pile yarn in each of said first channels from said pile yarns by displacement of said patterning pile yarn to a second end of each of said first channels, leaving non-patterning pile yarns at said first end and forming a shed therebetween prior to and during a beginning of a first course of knitting while said knitting needles are reciprocated behind said plane of said stationary pile sinkers;

a pile yarn inlayer associated with and disposed within each of said second channels of said guide comb at an initial position;

means for racking said guide comb and pile yarn inlayers from said initial position along a path parallel to said row of knitting needles and said pile sinkers a distance equivalent to a spacing of at least two of said knitting needles to a racked position while said knitting needles remain behind said plane of said stationary pile sinkers during a beginning of said first course;

means for lowering said pile yarn inlayers to effect underlapping of said patterning pile yarns upon arrival at said racked position and for simultaneously racking said guide comb back to said initial position and lowering said guide comb while said knitting needles remain positioned behind a plane of said stationary pile sinkers during said first course;

means for maintaining said pile yarn inlayers at the racked and lowered while extending said knitting needles to a position engagable with said patterning pile yarns;

means for raising and racking said pile yarn inlayers back to said initial position upon said knitting needles arriving at said position engagable with said patterning pile yarns;

means for tying said patterning pile yarns with said knitting needles and knitting yarns displaced to said extended position and retracting said knitting needles to said cast-off position to form piles with said patterning pile yarns and to tie down said piles completing said first course;

means for returning said patterning pile yarns to said first ends of said first channels subsequent to said tying and prior to a completion of said first course;

means for lowering said lower edge of said guide comb below said needle plane for underlapping said patterning pile yarns and tying down said pile yarns during a cycle of said knitting needles defining a second course; and means for selecting new patterning pile yarns during a beginning of said second course and displacing said patterning pile yarns to second ends of said first channel of said guide comb during said underlapping and tying said patterning pile yarns with said knitting yarns in said second course.

6. The apparatus according to claim 5 further comprising:

first means for stabilizing said comb sinker plates including end connecting members interconnecting said second ends of said comb sinker plates across said first channels; and second means for stabilizing said comb sinker plates including connecting members interconnecting said comb sinker plates across said second channels at positions disposed between said first and second ends and outside a range of displacement of said pile yarn inlayers in said second channel.

7. The apparatus according to claim 6 wherein said connecting members are formed from plastic.

8. The apparatus according to claim 6 further comprising:

said guide comb having a plurality of sinker holders supporting said first ends of said comb sinker plates;

said guide comb including a comb bar and means for detachably fastening said sinker holders to said comb bar adjacent each other;

end spacers, fixed in positions corresponding to positions of said connecting members, on outside surfaces of ones of said comb sinker plates disposed at ends of said sinker holders to space said sinker holders from one another; and said end spacers having a width less than said connecting members.

9. The apparatus according to claim 5, further comprising:

said comb sinker plates defining a first region of said first channels at said first ends for accepting said pile yarns including said patterning and non-patterning pile yarns;

said comb sinker plates defining a second region of said first channels extending from an end of said first region to said second end, for accepting said patterning pile yarns selected to form said shed; and said first regions having a width greater than said second regions.

10. The apparatus according to claim 9, further comprising:

said comb sinkers plates defining a first region of said second channels at said first ends for accepting said knitting needles;

said comb sinker plates defining a second region of said second channels, extending from an end of said first region to said second end, for accepting said pile yarn inlayers; and said second regions of said second channels having a width greater than said first regions of said first channels.

11. The apparatus according to claim 5, further comprising:

said comb sinker plates defining a first region of said second channels at said first ends for accepting said knitting needles;

said comb sinker plates defining a second region of said second channels, extending from an end of said first region to said second end, for said pile yarn inlayers; and said second regions of said second channels having a width greater than said first regions of said first channels.

12. A guide comb for a knitting machine having pile yarn inlayers and knitting needles, the guide comb comprising:

comb sinker plates having first and second ends;

mounting means for supporting said comb sinker plates at first ends thereof adjacent one another to define alternating first and second channels therebetween wherein each of said first channels has a width sufficient to accept a group of pile yarns at said first ends and each of said second channels has a width sufficient to accept one of said pile yarn inlayers;

first means for stabilizing said comb sinker plates including end connecting members bridging said second ends of said comb sinker plates across said first channels; and second means for stabilizing said comb sinker plates including connecting members bridging said comb sinker plates across said second channels at positions disposed between said first and second ends and outside a range of displacement of said pile yarn inlayers in said second channel.

13. The apparatus according to claim 12 further comprising:

said mounting means including a plurality of sinker holders disposed adjacent one another and supporting said first ends of said comb sinker plates;

said mounting means including a comb bar and means for detachably fastening said sinker holders to said comb bar;

end spacers, fixed in positions corresponding to positions of said connecting members, on outside surfaces of ones of said comb sinker plates disposed at ends of said sinker holders to space said comb sinker plates from one another; and said end spacers having a width less than said connecting members.

14. The apparatus according to one claims 12 or 13, further comprising:

said comb sinker plates defining a first region of said first channels at said first ends for accepting said pile yarns including patterning and non-patterning pile yarns;

said comb sinker plates defining a second region of said first channels extending from an end of said first region to said second end, for accepting said patterning pile yarns selected to form a shed; and said first regions having a width greater than said second regions.

15. The apparatus according to claim 14, further comprising:

said comb sinkers plates defining a first region of said second channels at said first ends for accepting said knitting needles;

said comb sinker plates defining a second region of said second channels, extending from an end of said first region to said second end, for accepting said pile yarn inlayers; and said second regions of said second channels having a width greater than said first regions of said first channels.

16. The apparatus according to one of claims 12 or 13, further comprising:

said comb sinkers plates defining a first region of said second channels at said first ends for accepting said knitting needles;

said comb sinker plates defining a second region of said second channels, extending from an end of said first region to said second end, for accepting said pile yarn inlayers; and said second regions of said second channels having a width greater than said first regions of said first channels.

* * * * *